US005784717A

United States Patent [19]

Singer

[11] Patent Number: 5,784,717

[45] Date of Patent: Jul. 28, 1998

[54] CLEANROOM COVERALL

[76] Inventor: John Stephen Singer, Bayberrie Dr., Westover Park, Stamford, Conn. 06902

[21] Appl. No.: 619,075

[22] Filed: Mar. 20, 1996

[51] Int. Cl.[6] ..... A41D 13/00

[52] U.S. Cl. ..... 2/79; 2/275; 2/901

[58] Field of Search ..... 2/79, 2, 69, 275, 2/902, 901, 114

[56] References Cited

U.S. PATENT DOCUMENTS

| | | | |
|---|---|---|---|
| 3,496,572 | 2/1970 | Herzig | 2/79 |
| 4,422,483 | 12/1983 | Zins | 2/69 |
| 4,590,623 | 5/1986 | Kitchman | 2/69 |
| 4,860,382 | 8/1989 | Markwell | 2/69 |
| 5,027,438 | 7/1991 | Schwarze et al. | 2/114 |
| 5,035,941 | 7/1991 | Blackburn | 2/2 |
| 5,511,246 | 4/1996 | Farka's et al. | 2/79 |

*Primary Examiner*—Gloria M. Hale
*Attorney, Agent, or Firm*—Bauer & Schaffer

[57] ABSTRACT

A garment is constructed by forming panels of first and second matching layers of two new and useful polyester fabrics sewn together along their edges. The composite panels are sewn together in such a fashion as to create a garment that will provide an effective barrier to dirt and dust particles.

5 Claims, 2 Drawing Sheets

CLEANROOM COVERALL

BACKGROUND OF THE INVENTION

The Present invention relates to improvements in the construction of an electrostatic cleanroom and method for assembly of the parts thereof.

In the manufacture of many products incorporating today's new technologies, it is necessary and essential to prevent contamination by dirt and dust particles commonly found on the clothing of those assembling or testing the products. During the manufacturing stage of certain types of highly sensitive products if dirt and dust particles come to rest on the surfaces of these products the product will begin to develop a higher and higher rate of failure to the point of being completely destroyed and made useless due directly to unwanted dust and dirt particles being deposited thereon. Enabling cleanroom workers to operate in a clean environment without contaminating the products with dust and dirt particles is a major concern in many fields requiring cleanroom manufacturing and testing. With the development of newer and more sensitive technologies the risk of contamination by smaller and smaller particles becomes even greater.

To date many attempts have been made to develop a garment which will prevent this type of contamination during the manufacturing process of the highly sensitive products of this current age. Currently known are different types of cleanroom garments. The current cleanroom garment technology attempts to cure the dust and dirt permeation problem through the use of single layered garments. Due to the technical inability to weave densely enough the threads of the fabrics used in these garments to prevent the permeation of the microscopic dirt and dust particles that will contaminate today's new products this technology can not supply the proper barrier to dust and dirt particles which will normally contaminate the surfaces of the products. This method of solving the problem has currently outlived its effectiveness and usefulness.

What is not known and is unique to the current invention is a cleanroom garment which is made of two electrostatic dissipative (ESD) fabric layers each impermeable to a certain microscopic size of dust and dirt which in turn are sewn together in such a new and useful manner to create a garment that prevents the permeation of dust and dirt particles larger that 0.02 microns.

What all of the present cleanroom garments lack and what is desirable to have is a cleanroom garment that can provide an effective barrier to dust and dirt particles as small as 0.02 microns. This longstanding but heretofore unfulfilled need is now fulfilled by the invention disclosed hereinafter.

SUMMARY OF THE INVENTION

The present invention relates generally to a coverall garment intended for use in cleanroom manufacturing environments to prevent the outward permeation of dirt and dust particles found on the surfaces of the normal outerwear of cleanroom personnel. These particles if left uncovered will become dislodged from the clothing of the cleanroom personnel and then become airborne and eventually settle onto the surfaces of the products being manufactured. These dust and dirt particles can cause serious damage to the products being manufactured.

In the present invention the fabrics used are electrostatic dissipative (ESD) fabrics that are pattern-cut and sewn together in patterned panels. The pattern panels are then sewn together, or assembled, into a finished coverall. The seams and panel joinings are especially designed to prevent permeation of particles larger than 0.02 microns.

The novelty of the present invention is that for the first time a cleanroom garment can be produced which prevents the permeation of dirt and dust particles thereby protecting the particle-sensitive product being manufactured.

Full details of the present invention are set forth in the following description and in the accompanying drawings.

BRIEF DESCRIPTION OF THE DRAWINGS

For a more complete understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
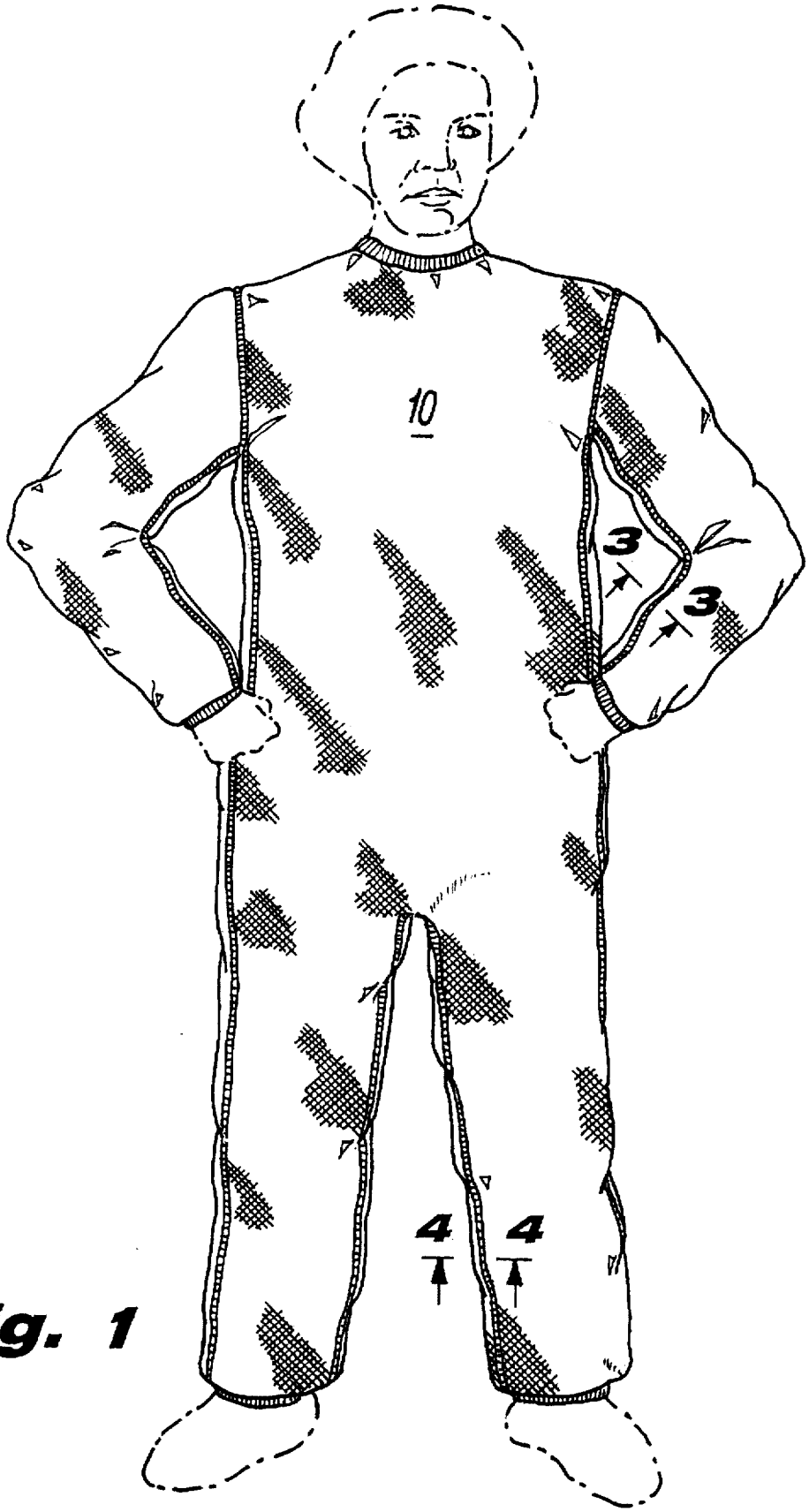
FIG. 1 is a front elevational view of a cleanroom garment as worn.
Figure 2:
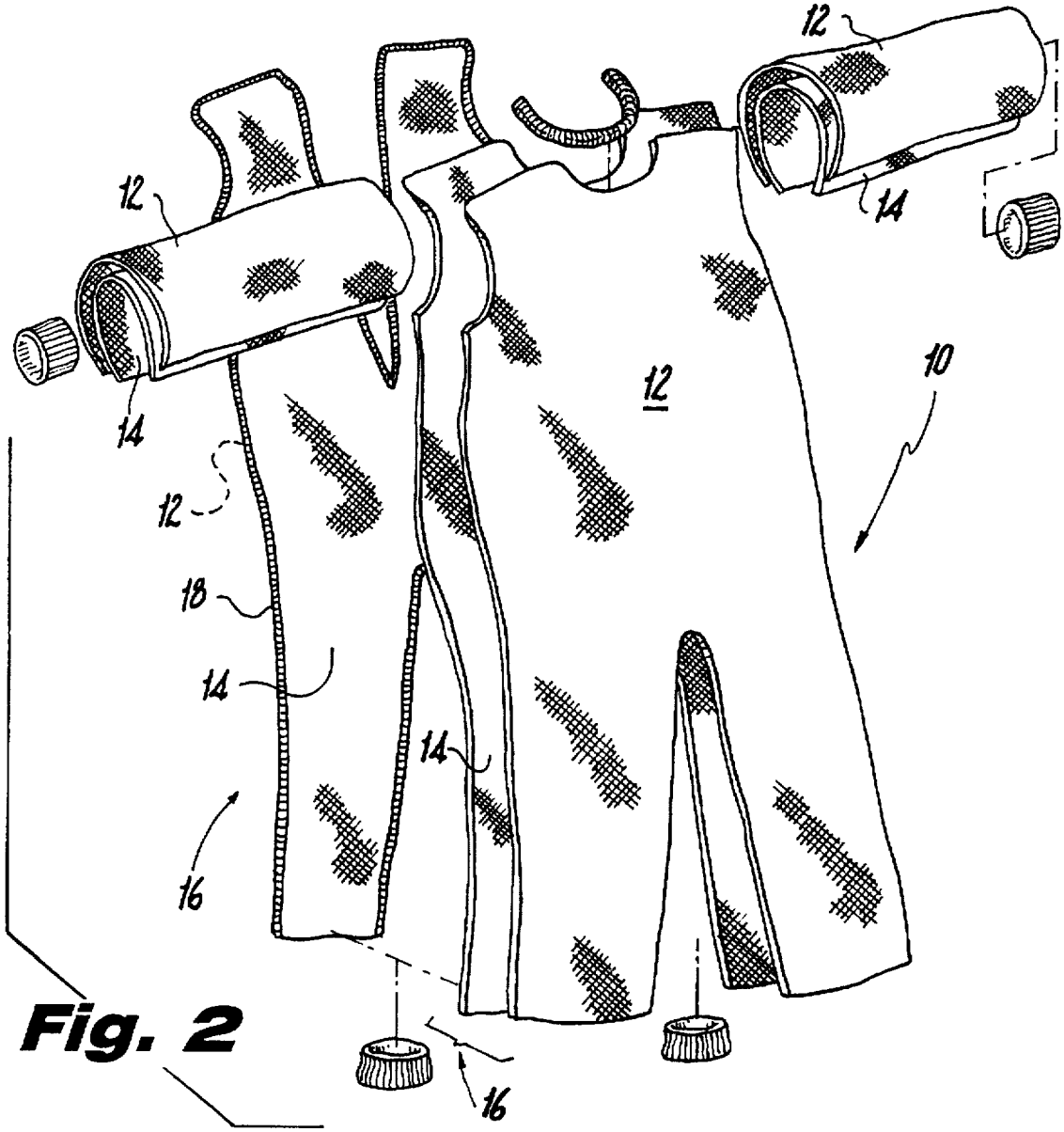
FIG. 2 is an exploded perspective view showing the manner in which the individual panels of the garment are assembled.
Figure 3:
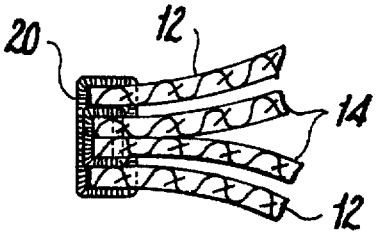
FIG. 3 is a sectional view along line 3—3 of FIG. 1.
Figure 4:
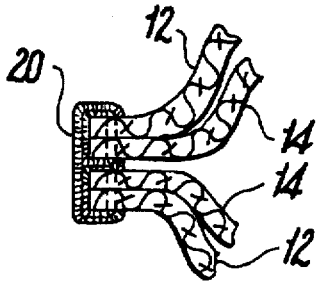
FIG. 4 is a sectional view along line 4—4 of FIG. 1.

The cleanroom garment, generally depicted by the numeral 10 in FIG. 1, is constructed as shown in FIGS. 2–4. In accordance with the present invention, the garment comprises a plurality of shaped panels, each having an outer layer 12 of polyester, electrostatic dissipative (ESD) fabric and an inner layer 14 of polyester, ESD fabric. The outer layer 12 of fabric is preferably a material called "Selguard IV" and the inner layer 14 of fabric is preferably a material called "Selguard 110." Both materials are manufactured by Teijin, Ltd. of Osaka, Japan. However, other, similar materials may be used instead.

Selguard IV is a fabric made of 100% polyester. The twill style weaving of the electro-conductive yarn utilized has a warp spacing of 0.5 mm and a weft spacing of 0.5 mm. The twill weaving produces a warp density of 159 threads/in and a weft density of 120 threads/in. Selguard IV prevents filtration of particles larger than 0.3 microns. Selguard IV is light weight, weighing 120 g/m$^2$. Selguard 110 is also 100% polyester. The weaving structure is plain. The warp spacing and weft spacing are the same as the Selguard IV, namely, 0.5 mm and 0.5 mm, respectively. The plain weaving of the Selguard 110 produces a warp density of 91 threads/in and a weft density of 83 threads/in. Selguard 110 prevents filtration of particles larger than 0.3 microns. Selguard 110 has a weight of 58 gr/m$^2$.

Selguard IV is the trade name of Teijin, Ltd., Osaka Japan, for its ultra high performance fabric designed specifically for Class 10; and Class 1 Cleanrooms—when used as an outer garment with Selguard 110 as an undergarment. Smaller, more densely spaced pores in this fabric block sub-micron particles but-pass adequate air and moisture to allow the operator comfort. Selguard IV fabric is composed of polyester filament yarns—75 denier warp threads/100 denier filling threads (weft) woven in a twill pattern with a density of 159 warp threads/inch and 120 filling (weft) threads/inch, incorporating electro conductive carbon yarn of 0.5 mm, both warpwise and fillingwise in a 5 mm grid pattern woven into the fabric. This results in surface resistivity (ohm/sq) of the warp $5.8\times10^5$, filling (weft) $9.2\times10^5$ and Particle Filtration Efficiency of 85 @ 0.3μ, 88 @ 0.5μ. Selguard 110 is the trade name of Teijin, Ltd., for its unique plain wave undergarment fabric of electro conductive carbon yarns and 75 denier filament polyester warp threads and 75 denier filament polyester filling (weft) threads with a density of 91 warp threads and 83 filling (weft) threads to reduce the particle density within the outer garment shell.

The integral joining of the Selguard IV and the Selguard 110 as one apparel unit to form a bilayered cleanroom garment ensures a nonporous construction. When these two fabrics are sewn together the unit more effectively blocks particulate contamination of the cleanroom environment than a single layer or two separate garments.

Thus, according to the present invention, the outer and inner layers 12 and 14 of fabric are each cut into separate pieces (i.e. sleeves, fronts, backs, etc.), which make up a defined shaped and structured part 16, of a finished garment 10. These parts 16 are then sewn together along the appropriate seams 18 to form separate patterned panels of integrated parts having an outer layer 12 of Selguard IV and an inner layer 14 of Selguard 110. The Selguard IV and Selguard 110 panels are merrowed together, as seen in FIGS. 3 and 4, to provide an overlapping closure 20. When the Selguard IV and the Selguard 110 are merrowed together the particle filtration drops to particles as small as 0.2 microns.

After the panels are completed the panels are sewn together at seams as the finished coverall 10 shown in the Figures. The seams sewn by merrowing are also especially designed to decrease the particle filtration. The finished garment will be provided with snaps or elastic necks and cuffs to snugly fit the cleanroom personnel.

It shall be noted that all of the above description and accompanying drawings of the invention are to be considered illustrative and are not to be considered in the limiting sense.

It is also understood that the following claims are intended to cover all of the generic and specific embodiments and features of the invention herein described.

What is claimed is:

1. A cleanroom coverall comprising:

an inner and outer layer of fabric material, said inner layer comprising a first set of panels formed of a first electrostatic fabric material, each of said panels of said first set having shape and size conforming to a portion of wearer's body, said outer layer comprising a second set of panels formed of a second electrostatic fabric material, each of said panels of said second set being respectively shaped and sized to conform to a panel in said first set, each of said first and second fabric materials being capable of preventing the passage therethrough of particles greater than 0.3 microns, said panels of said first and second sets being arranged along their peripheral edges in respective pairs so as to form said coverall, the edges between adjacent pairs of said panels being joined in a four ply seam so that the peripheral edges of said first panels in adjacent paired panels are in abutment with each other and the peripheral edges of said second panels in said adjacent paired panels overly the edges of the first panels, said coverall when assembled being capable of preventing the passage of particles equal to and greater then 0.2 microns.

2. The cleanroom coverall as claimed in claim 1, wherein the abutting first panels of said adjacent pairs are sewn together and the overlaying second panels of said adjacent pairs are sewn integrally with said first panels.

3. The cleanroom coverall as claimed in claim 1, wherein one of the abutting first panels of said adjacent pairs is sewn to one of the overlying second panels in the same pair, the other abutting first panel of said adjacent pairs being sewn to the other overlying second panel in the same pair, and the sewn pairs of first and second panels are sewn together.

4. The cleanroom coverall as claimed in claim 1, wherein said first electrostatic fabric is a plain woven polyester and said second electrostatic fabric is a twill polyester.

5. The method for constructing a cleanroom coverall comprising the steps of preparing an inner and outer layer of fabric material, said inner layer comprising a first set of panels formed of a first electrostatic fabric material, each of said panels of said first set having shape and size conforming to a portion of wearer's body, said outer layer comprising a second set of panels formed of a second electrostatic fabric material, each of said panels of said second set being respectively shaped and sized to conform to a panel in said first set, and each of said first and second fabric materials being capable of preventing the passage therethrough of particles greater than 0.3 microns, and sewing said panels of said first and second sets together along their peripheral edges in respective pairs so as to form said coverall, the edges between adjacent pairs of said panels being joined in a four ply seam so that the peripheral edges of said first panels in adjacent paired panels are in abutment with each other and the peripheral edges of said second panels in said adjacent paired panels overly the edges of the first panels, said coverall when assembled being capable of preventing the passage of particles equal to and greater then 0.2 microns.

* * * * *